US005457302A

United States Patent [19]

Amano et al.

[11] Patent Number: 5,457,302

[45] Date of Patent: Oct. 10, 1995

[54] HEAT COOKING APPARATUS WITH CONTROLLABLE HEAT SOURCE

[75] Inventors: Tsunehisa Amano, Tottori; Takuo Ohara, Yazu; Yoshifumi Osaki, Tottori, all of Japan

[73] Assignees: Tottori Sanyo Electric Co., Ltd., Tottori; Sanyo Electric Co., Ltd., Moriguchi, both of Japan

[21] Appl. No.: 936,855

[22] Filed: Aug. 27, 1992

[30] Foreign Application Priority Data

| | | | |
|---|---|---|---|
| Aug. 27, 1991 | [JP] | Japan | 3-215291 |
| Aug. 27, 1991 | [JP] | Japan | 3-215292 |
| Aug. 29, 1991 | [JP] | Japan | 3-218852 |
| Aug. 29, 1991 | [JP] | Japan | 3-218853 |

[51] Int. Cl.[6] ..... H05B 1/02

[52] U.S. Cl. ..... 219/492; 219/497; 219/506; 219/719; 99/327; 426/523

[58] Field of Search ..... 219/710, 492, 219/497, 501, 506, 499, 491, 719; 99/325–328, 329, 451; 426/243, 523

[56] References Cited

U.S. PATENT DOCUMENTS

| | | | |
|---|---|---|---|
| 4,396,817 | 8/1983 | Eck et al. | 219/710 |
| 4,447,693 | 5/1984 | Buck | 219/710 |
| 4,771,152 | 9/1988 | Eke | 219/710 |
| 4,918,276 | 4/1990 | Oh | 219/710 |
| 5,155,339 | 10/1992 | An | 219/492 |

FOREIGN PATENT DOCUMENTS

| | | |
|---|---|---|
| 28217 | 3/1983 | Japan . |
| 6367106 | 11/1983 | Japan . |
| 228062 | 1/1985 | Japan . |

*Primary Examiner*—Mark H. Paschall
*Attorney, Agent, or Firm*—Hoffmann & Baron

[57] ABSTRACT

A heat cooking apparatus includes a gas burner, and a temperature sensor for sensing a food correlative temperature. A microcomputer determines a category of the food on the basis of a time necessary for raising a temperature of the food by a predetermined temperature, and sets a termination temperature according to the category. If the time is more than a predetermined value, the microcomputer determines that the food is "boiled food", and sets a boiled food termination temperature. If the time is less than a predetermined value and a temperature drop occurs during temperature raising, the microcomputer determines that the food is "fried food", and sets a fried food upper limit temperature. If the time is less than a predetermined value and no temperature drop occurs during temperature raising, the microcomputer determines that the food is "deep-fried food", and sets a deep-fried food upper limit temperature. If the temperature of the food reaches the termination temperature or any of the upper limit temperatures, the microcomputer stops burning of the gas burner.

16 Claims, 12 Drawing Sheets

HEAT COOKING APPARATUS WITH CONTROLLABLE HEAT SOURCE

BACKGROUND OF THE INVENTION

1. Field of the Invention

The present invention relates to a heat cooking apparatus. More specifically, the present invention relates to a heat cooking apparatus, in which the food is heated by a cooking heat source such as a gas burner or the like, and a temperature of the food is detected by a temperature sensor, and the cooking heat source is controlled on the basis of the temperature.

2. Description of the Prior Art

In such a kind of conventional heat cooking apparatus, as disclosed Japanese Patent Publication Nos. 67106/1988, 8217/1990, and 28062/1990, burning is automatically controlled by a proportional control valve according to gradient of the temperature raising of the food. However, in the prior arts, a cost becomes relatively high because such a proportional control valve is used.

Furthermore, in any of the above described prior arts, since there is no function for automatically determining a category of the food, if a user erroneously sets an upper limit temperature, it is difficult to cook the food well. For example, if a fish is broiled while an upper temperature is set at a flash temperature of a cooking oil, it is impossible to obtain strong burning necessary for the broiled food. Accordingly, since the fish becomes to be broiled for a long time at a low temperature, the fish cannot be cooked with a good taste.

SUMMARY OF THE INVENTION

Therefore, a principal object of the present invention is to provide a novel heat cooking apparatus.

Another object of the present invention is to provide a heat cooking apparatus, in which it is possible to perform an optimal temperature control according to a category of the food.

Another object of the present invention is to provide a heat cooking apparatus, in which it is possible to cook with an optimal temperature for boiled food, if the food is determined as the boiled food.

Another object of the present invention is to provide a heat cooking apparatus, in which it is possible to cook with an optimal temperature for fried food, and it can prevent the food from being scorched and a cooking oil from catching fire, if the food is determined as the fried food.

Another object of the present invention is to provide a heat cooking apparatus, in which it is possible to cook with an optimal temperature for deep-fried food, and it can prevent a cooking oil from catching fire, if the food is determined as the deep-fried food.

Another object of the present invention is to provide a heat cooking apparatus, in which it is possible to broil the food with strong heat, if the broiled food is selected.

A heat cooking apparatus in accordance with the present invention comprises: a controllable heat source for heating food; a temperature sensor for detecting a food correlative temperature; time counting means for counting a time required for raising the food correlative temperature by a predetermined temperature; determining means for determining a category of the food on the basis of the time counted by the time counting means; stop temperature setting means for setting stop temperatures that are different from each other according to the category of the food; and stopping means for stopping the controllable heat source when the food correlative temperature reaches the stop temperature.

In the present invention, it is determined whether the food is any one of "boiled food", "fried food", "deep-fried food", and "broiled food".

If the boiled food is determined, a boiled food termination temperature is set by the stop temperature setting means. The boiled food termination temperature ($T_E$) is set on the basis of a reference temperature (T) at a time when temperature raising gradient is minimum, after the food correlative temperature reaches more than 100° C., for example. Specifically, boiled food the termination temperature ($T_E$) is set as a temperature of the reference temperature (T) plus 20° C.

If the fried food is determined, a fried food upper limit temperature (260° C., for example) is set by the stop temperature setting means.

If the deep-fried food is determined, a deep-fried food upper limit temperature (260° C., for example) is set by the stop temperature setting means.

If a broiling key is operated, the stop temperature setting means changes a first upper limit temperature (200° C., for example) to a first broiled food upper limit temperature of 370° C., for example. However, the food is determined as the broiled food only when a raising trend of the food correlative temperature shows a predetermined raising trend. If the broiled food is determined, the stop temperature setting means further sets a second broiled food upper limit temperature 330° C., for example). If the food correlative temperature approaches the first broiled food upper limit temperature, for example, a buzzer is driven so that a user is demanded to make the heat small. Then, if the food correlative temperature drops by a predetermined value (80° C., for example), the buzzer is stopped. However, the stopping means stops the controllable heat source when the food correlative temperature reaches the first broiled food upper limit temperature or the second broiled food upper limit temperature.

In accordance with the present invention, since a category of the food is automatically determined by the heat cooking apparatus and the controllable heat source is controlled according to the category of the food, the food can be cooked well with a simple operation in comparison with the conventional ones. In addition, the stopping temperature is set according to the category of the food, and the controllable heat source is controlled according to the stopping temperature, and thus, a heat cooking apparatus according to the present invention is much safer than the conventional ones.

The above described objects and other objects, features, aspects and advantages of the present invention will become more apparent from the following detailed description of the present invention when taken in conjunction with the accompanying drawings.

DETAILED DESCRIPTION OF THE PREFERRED EMBODIMENTS

Figure 1:
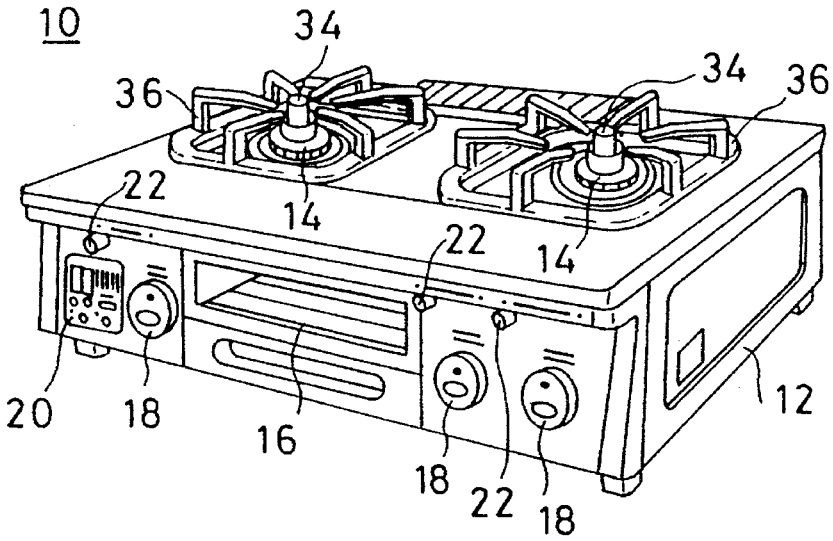
FIG. 1 is a perspective view showing a cooking gas table as one embodiment in accordance with the present invention.
Figure 2:
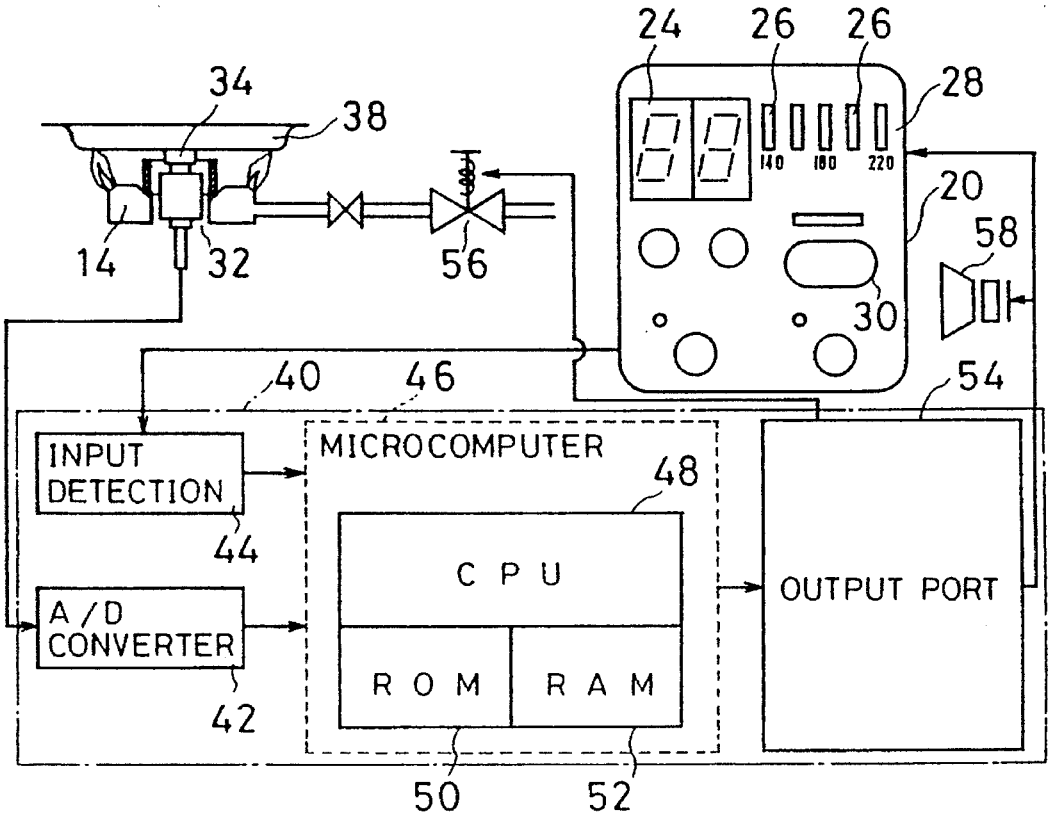
FIG. 2 is a block diagram showing FIG. 1 embodiment.

FIG. 1 is a perspective view showing a cooking gas table as one embodiment in accordance with the present invention, and FIG. 2 is its block diagram. In the following, a description will be made in a case where the present invention is applied to a cooking gas table; however, it is pointed out in advance that the present invention can be also applied to a heat cooking apparatus other than a cooking gas table otherwise limited to.

With referring to FIG. 1, a cooking gas table 10 of this embodiment shown includes a cooking gas table body 12, and a pair of ring gas burners 14 are provided at right and left sides on a top surface of the cooking gas table body 12. A grill 16 is arranged below and between the ring gas burners 14, and ignition buttons 18, an operation panel 20 and controllers 22 are arranged on a front surface of the cooking gas table body 12. Each grill burner (not illustrated) which is provided within each of the ring gas burners 14 and the grill 16 is ignited by respective one of the ignition buttons 18.

As shown in FIG. 2, the operation panel 20 includes a two-digit digital (seven segment) display 24, a temperature indicator 28 which consists of five LCD bars 26, a broiling key 30 for selectively setting "broiled food", and etc. The controllers 22 are used for manually controlling burning degrees of the ring gas burners 14 and the grill burners.

In addition, in a vent hole 32 (FIG. 2) formed in the center of each of the ring gas burners 14, a temperature sensor 34 including a thermister or the like is arranged. Then, trivets 36 are detachably provided around the ring gas burners 14, respectively. A pan 38 such as a frying pan, a cooking pan or the like can be put on each of the trivets 36. Since the temperature sensor 34 is always pushed upward by a spring or the like (not illustrated), the temperature sensor 34 detects a temperature of the pan 38, and thus, a temperature of the food (not illustrated) within the pan 38 while the same is brought into contact with a bottom of the pan 38.

Furthermore, a control circuit 40 as shown in FIG. 2 is contained in the cooking gas table body 12. The control circuit 40 includes an A/D converter 42 for converting an analog signal from the temperature sensor 34 into digital temperature data, an input detection circuit 44 for detecting operations of the ignition buttons 18, and etc. The temperature data from the A/D converter 42 and an input signal from the input detection circuit 44 are applied to a microcomputer 46. The microcomputer 46 includes a CPU 48, a ROM 50 and a RAM 52. In the ROM 50, a program according to flowcharts shown in FIGS. 3A–3G is stored in advance and, in the RAM 52, flag areas, counter areas, register areas, and etc. are respectively formed. Via an output port 54, the microcomputer 46 controls a solenoid valve 56 which controls gas supply to the ring gas burners 14, and the microcomputer 46 controls a buzzer 58, the above described digital display 24 and temperature indicator 28, and etc.

In cooking, at first, as shown in FIG. 2, the pan 38 containing the food is put on the trivet 36. Then, in a step S1 shown in FIG. 3A, the ignition button 18 for the ring gas burner 14 on which the pan 38 is set is operated. According to an input signal from the input detection circuit 44, the microcomputer 46 detects that the ignition button 18 is operated. In a step S3, the ring gas burner 14 is ignited to start the heat cooking. In a succeeding step S5, the microcomputer 46 sets a temperature around 200° C., for example, in a suitable register area in the RAM 52 (FIG. 2) as a first upper limit temperature.

Then, in a step S7, the temperature data from the A/D converter 42 is fetched in the microcomputer 46. In a next step S9, according to an input signal from the input detection circuit 44, the microcomputer 46 determines whether or not the broiling key 30 is operated. If the broiling key 30 is operated, the process jumps to a step S73 shown in FIG. 3E. On the other hand, if the broiling key 30 is not operated, in a succeeding step S11, the microcomputer 46 determines whether or not an initial temperature of the food (a temperature at a start of the cooking) is less than 80° C. on the basis of the temperature data from the A/D converter 42.

Figure 4:
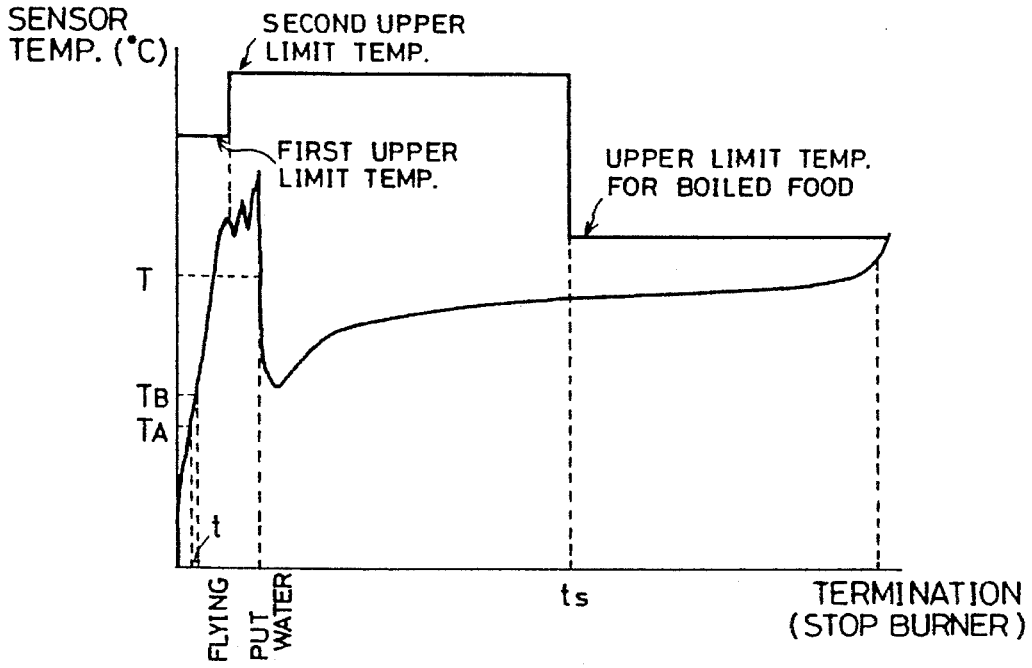
FIG. 4 is a graph showing a temperature-time characteristic in cooking the fried food or boiled food.

If the initial temperature of the food is less than 80° C., in a step S13, the microcomputer 46 counts a time (t) required for raising a temperature of the food from a predetermined temperature $T_A$ (80° C., for example) to a predetermined temperature $T_B$ (90° C., for example) as shown in FIG. 4, and stores the time (t) in a suitable area of the RAM 52.

If the initial temperature of the food exceeds 80° C. in the step S11, in a step S15, the microcomputer 46 determines whether or not the initial temperature is within a range of 81° C.–93° C. If the initial temperature of the food is within the range, in a step S17, the microcomputer 46 counts a time required for raising a temperature of the food by 3° C. from the initial temperature, and stores the time in the RAM 52 as "t/2".

If the initial temperature of the food exceeds 93° C. in the step S15, in a step S19, the microcomputer 46 determines whether or not the initial temperature is within a range of 94° C.–97° C. If the initial temperature of the food is within the range, in a step S21, the microcomputer 46 counts a time required for raising a temperature of the food by 1.5° C. from the initial temperature, and stores the time in the RAM 52 as "t/2".

If the initial temperature exceeds 97° C., in a step S23, the microcomputer 46 sets a fixed value (10 seconds, for example) that is determined in advance in the RAM 52 as "t/2".

After the step S13, S17, S21 or S23, the process proceeds to a step S25. In the step S25, the microcomputer 46 counts a time (X) required for raising the temperature of the food 0.5° C. by 0.5° C. from the temperature just after the counting the above described time. Then, in a next step S27 shown in FIG. 3B, the microcomputer 46 determines whether or not the time (X) is larger than a predetermined value "t/2" that has been set in the step S13, S17, S21 or S23, for example. If the time (X) is less than the predetermined value, the process jumps to the step S47 shown in FIG. 3C. On the other hand, if the time (X) is more than the predetermined value, in a step S29, the microcomputer 46 determines that the food is "boiled food".

Figure 5:
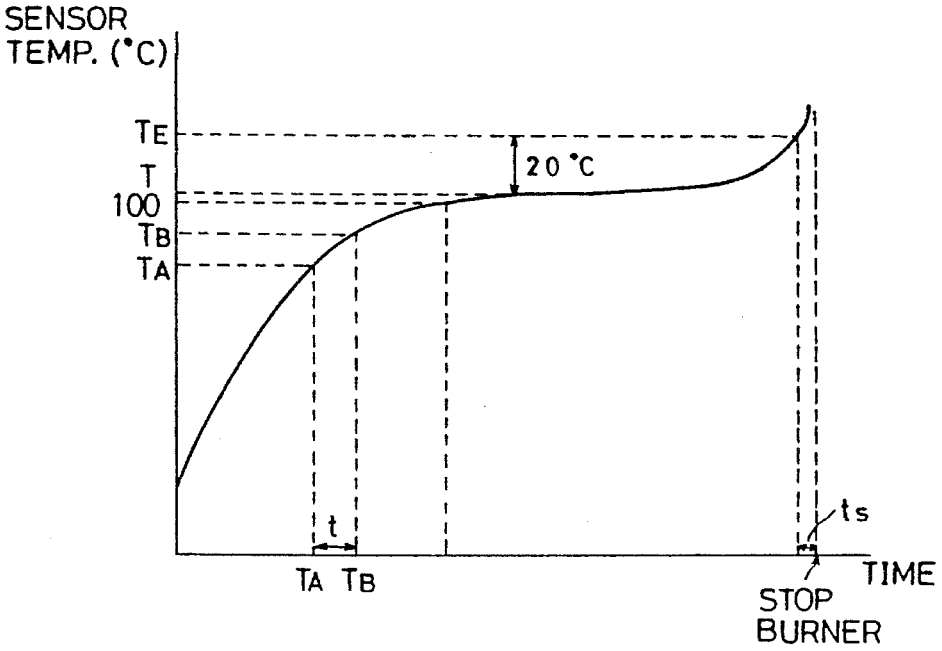
FIG. 5 is a graph showing a major portion of a temperature-time characteristic in cooking the boiled food.

During boiling, a water content in the pan 38 is decreased through absorption by the food, vaporization, and etc., but a gradient of a sensor temperature of the temperature sensor 34 becomes relatively flat. Then, if the microcomputer 46 determines that the sensor temperature exceeds a predetermined temperature (100° C., for example) in a step S31, in a step S33, the microcomputer 46 stores a temperature at a timing when a temperature raising gradient is minimum in a suitable area of the RAM 52 as a reference temperature (T: FIG. 5).

Then, in a step S35, the microcomputer 46 evaluates a termination temperature for boiled food ($T_E$=T+20) on the basis of the reference temperature (T), and sets the temperature ($T_E$) in the RAM 52. In a step S37, the microcomputer 46 determines whether or not the temperature raising gradient becomes further small. If "YES" is determined in the step S37, the process returns to the step S33 so that the microcomputer 46 renews a temperature at a timing when the temperature raising gradient is minimum. Thus, the reference temperature (T) is stored in the RAM 52 while the same is always renewed.

If it is determined that the sensor temperature reaches the boiled food termination temperature ($T_E$) in a step S39, in a step S41, the microcomputer 46 determines whether or not a temperature drop occurs within a predetermined time ($T_S$: 10 seconds, for example). If the temperature drop occurs, the process returns to the step S33. On the other hand, if no temperature drop occurs, the microcomputer 46 closes the solenoid valve 56 in a step S43, and stops the burning of the ring gas burner 14 in a step S45 so as to terminate the cooking.

For example, if new ingredients of the food are placed into the pan 38, the sensor temperature drops within the predetermined time ($T_S$). In such a case, the microcomputer 46 keeps the solenoid valve 56 open. The microcomputer 46 executes steps from the step S33 to the step S39 again so as to determine whether or not the boiled food termination temperature ($T_E$) is reached again. Thus, if the temperature drop occurs within the predetermined time ($T_S$), by repeating the same process, there occurs no inconvenience such that the ring gas burner 14 is not extinguished in the course of the boiling even if the food in the pan 38 is agitated, or the pan 38 is taken off temporarily. Accordingly, only at a timing when the boiling is finished, the ring gas burner 14 is extinguished surely.

In addition, if the cooking is to be stopped until the sensor temperature reaches the boiled food termination temperature ($T_E$), the ignition button 18 may be operated such that the ring gas burner 14 can be manually extinguished.

Figure 3A:
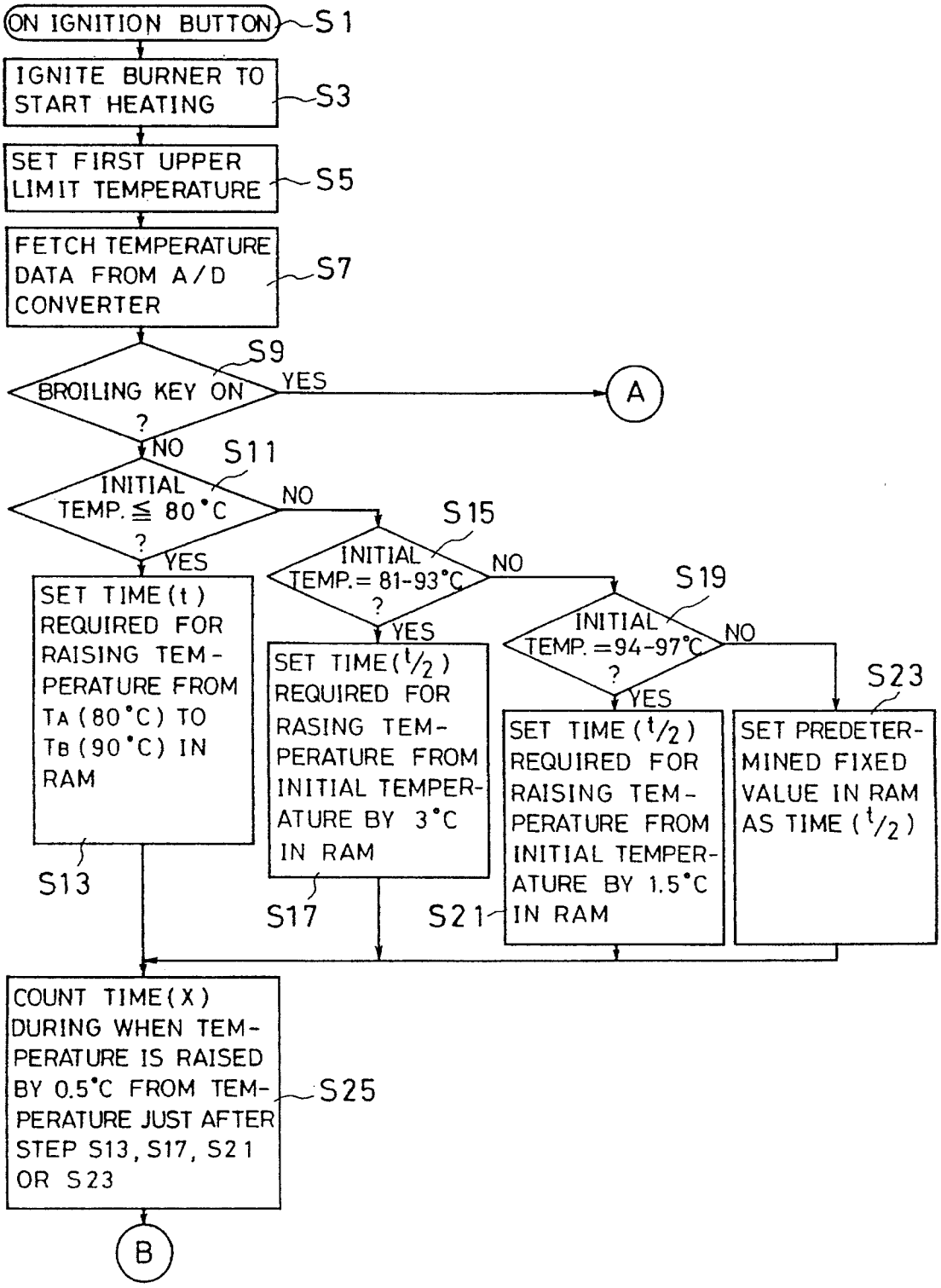
FIGS. 3A–3G are flowcharts showing an operation of the embodiment.
Figure 3B:
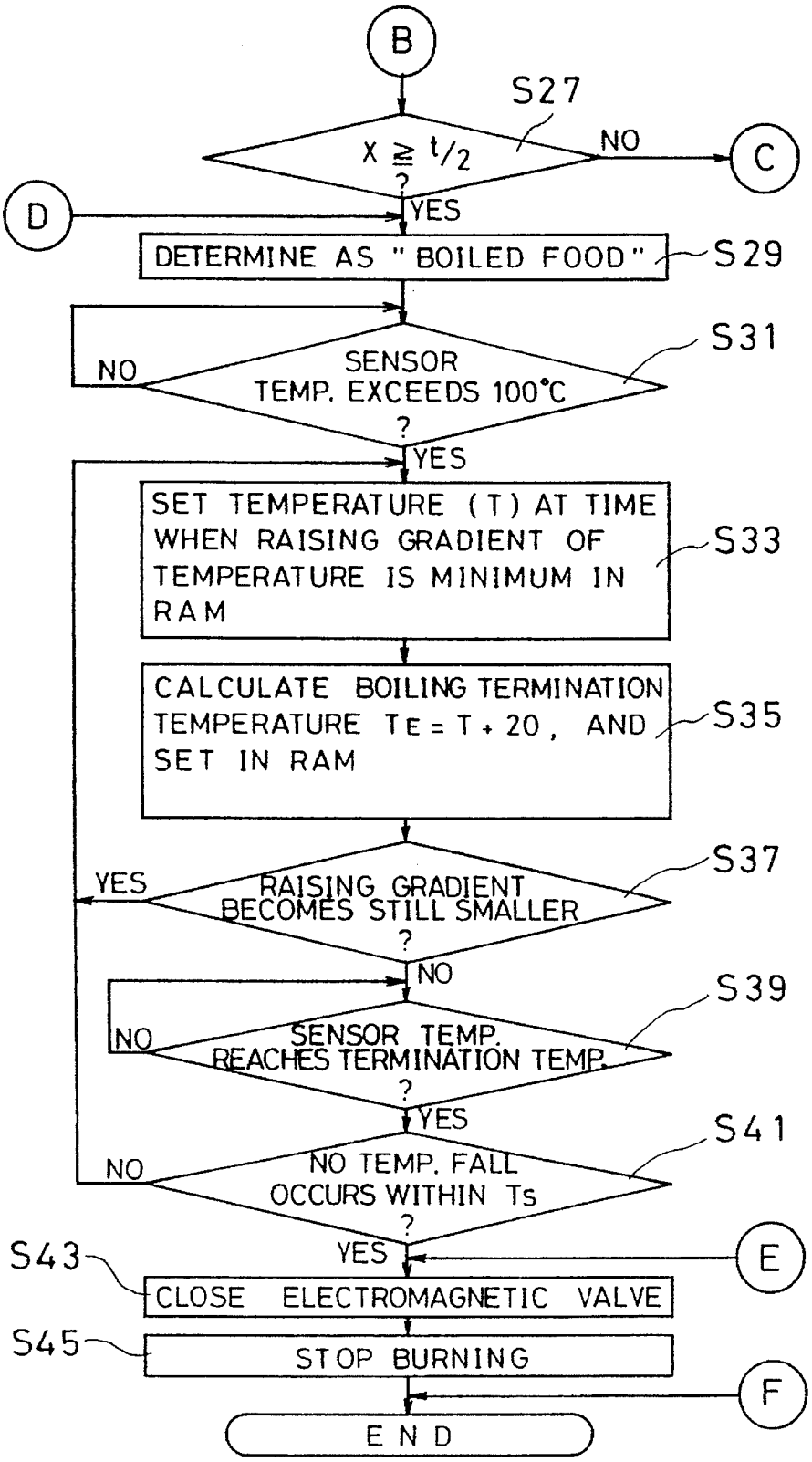
Figure 3C:
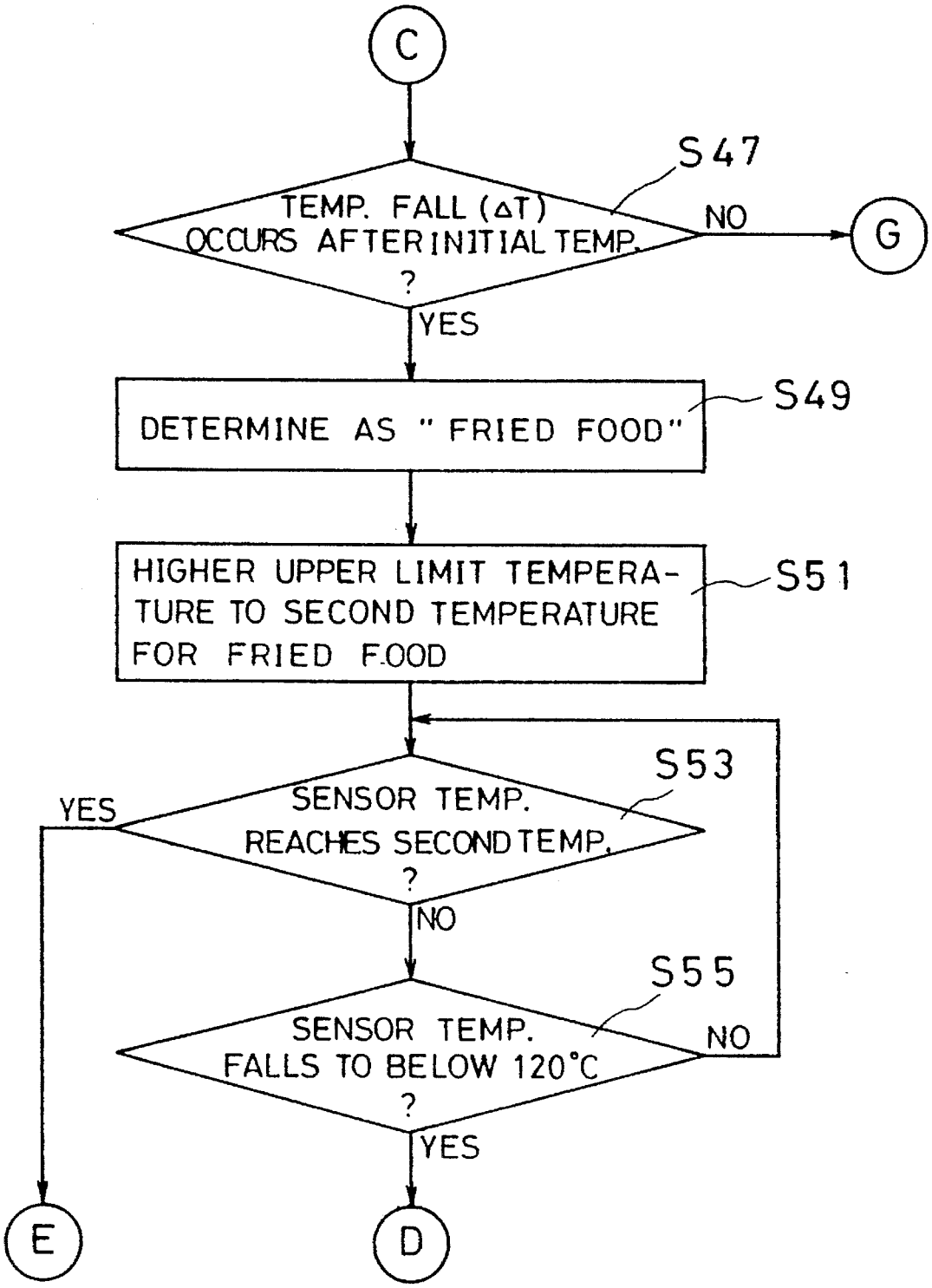
Figure 6:
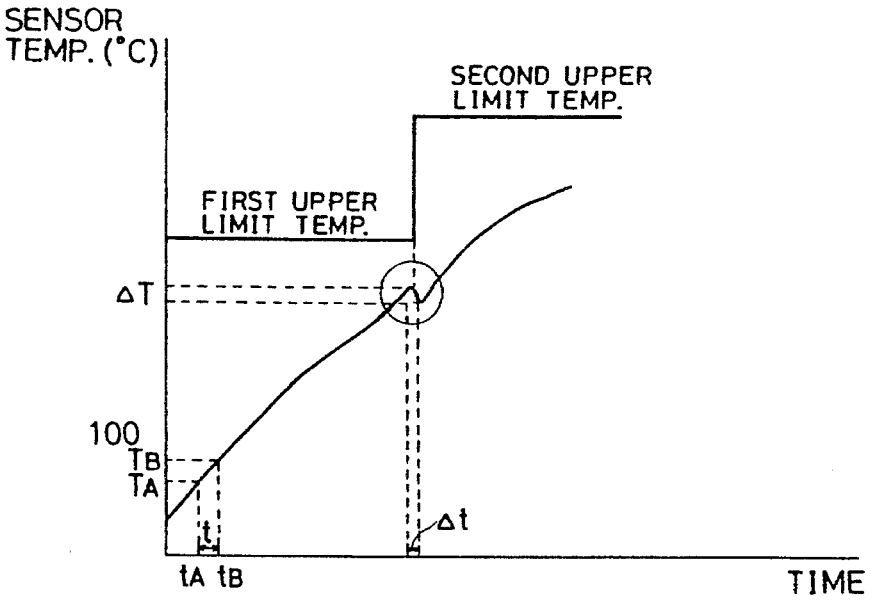
FIG. 6 is a graph showing a major portion of a temperature-time characteristic in cooking the fried food.

On the other hand, in a case where the temperature raising time (X) is shorter than "t/2" in the step S27, in a step S47 shown in FIG. 3C, the microcomputer 46 determines whether or not a temperature drop of a predetermined value (ΔT: 0.5° C., for example) during the sensor temperature is being raised from the initial temperature. If ingredients such as a vegetable, sausage, and so on are placed into the pan 38, the temperature drop more than such the predetermined temperature occurs as shown in FIG. 6; however, in this case, in a step S49, the microcomputer 46 determines that the food is "fried food".

Furthermore, in a case of the fried food, generally, after the pan 38 is put on the trivet 36, the ring gas burner 14 is ignited, and thereafter, a cooking oil is placed into the pan 38 after a temperature of the pan 38 is raised to same extent, and then, ingredients such as a vegetable, and etc. are placed into the pan 38. Accordingly, the above described temperature drop occurs around a time when the sensor temperature exceeds 100° C.; however, there are some cases where the temperature drop occurs by placing the ingredients into the pan 38 around the above described temperature range $T_A$–$T_B$. Accordingly, in this embodiment shown, the microcomputer 46 determines whether or not the temperature drop occurs even when the temperature does not reach the predetermined temperature range $T_A$–$T_B$ and, if the microcomputer 46 detects the temperature drop, the microcomputer 46 also determines that the food is "fried food" in this case.

Then, in a step S51, the microcomputer 46 changes the first upper limit temperature of about 200° C., for example (the step S5) to a second upper limit temperature of a temperature that is suitable for "fried food" and the cooking oil is not flashed or ignited, for example, about 260° C. Thereafter, in a step S53, the microcomputer 46 determines whether or not the sensor temperature reaches the second upper limit temperature. If the second upper limit temperature is reached, the process jumps to the further step S43 and S45 (FIG. 3B) such that the burning of the ring gas burner 14 is stopped. As a result thereof, even if a little cooking oil exists in the pan 38, it is possible to prevent an igniting or flashing accident from occurring.

In addition, after the "fried food" is determined, if the sensor temperature suddenly drops to a specific temperature (120° C., for example) that has been set in advance in a step S55, the microcomputer 46 determines that the food is correctly "boiled food" such as stew, curry, or the like in which the food is to be boiled without haste and with much water. However, if the sensor temperature does not become less than the specific temperature in the step S55, the process returns to the step S53.

Figure 3D:
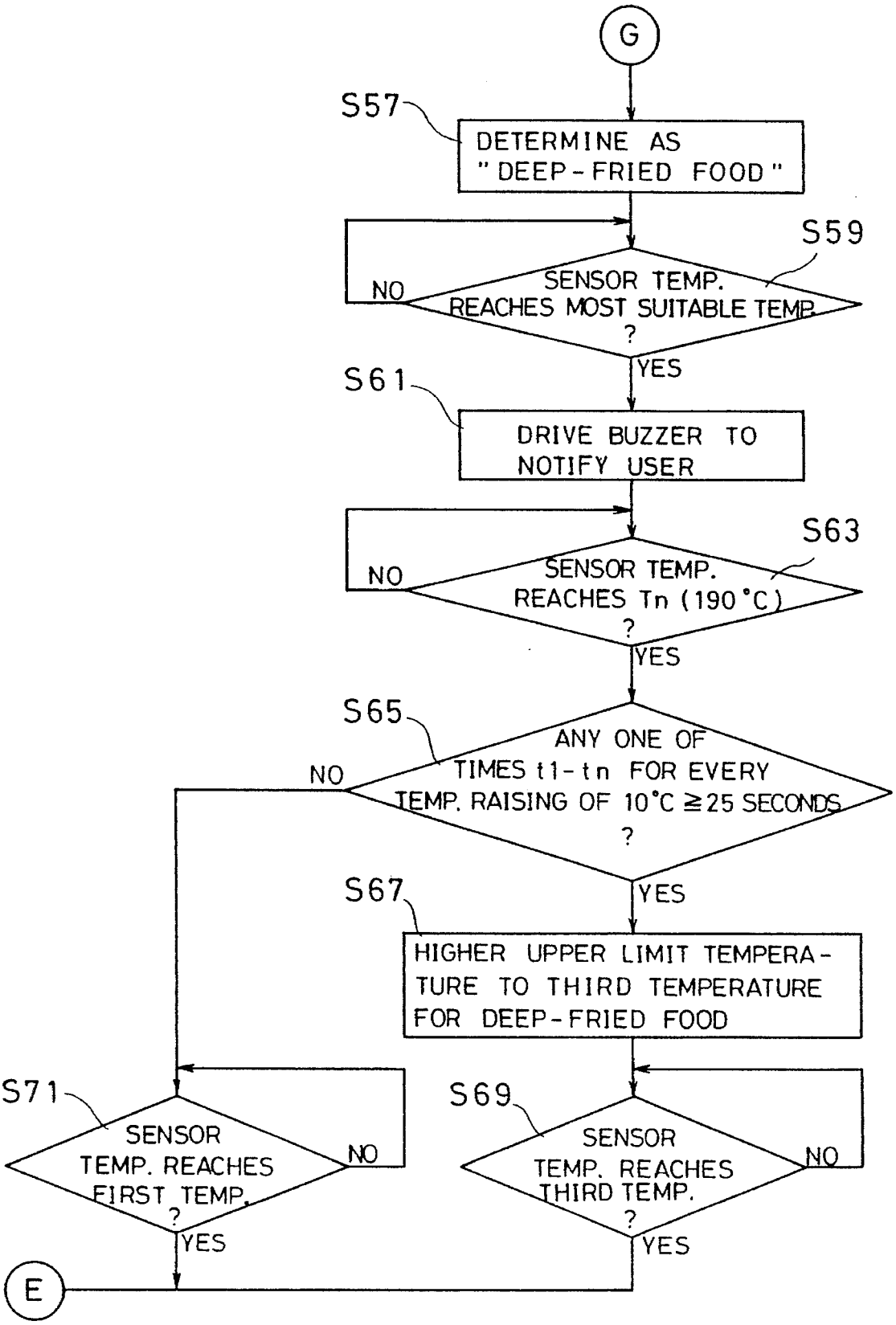
Figure 7:
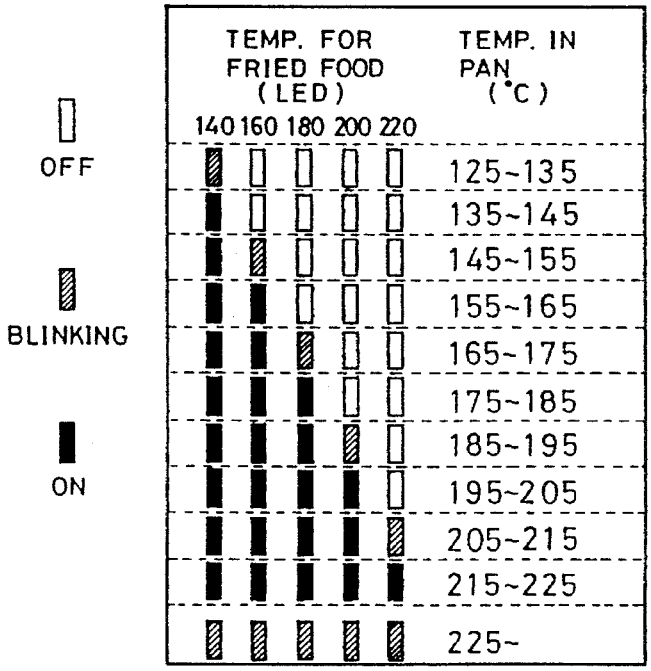
FIG. 7 is an illustrative view showing an indicating state of a temperature indicator.

On the other hand, in a case where the above described temperature drop (ΔT) does not occur from the initial temperature while the temperature is raised, in the step S47, the microcomputer 46 determines that the food is "deep-fried food" in a step S57 shown in FIG. 3D. Then, according to rise of the sensor temperature, as shown in FIG. 7, respective LED bars 26 of the temperature indicator 28 are sequentially lightened or flashed. Thereafter, if the sensor temperature reaches a temperature most suitable for the "deep-fried food", for example 180° C. in a step S59, the buzzer 58 is driven so that a user is urged or demanded to get ingredients into the pan 38.

Figure 8:
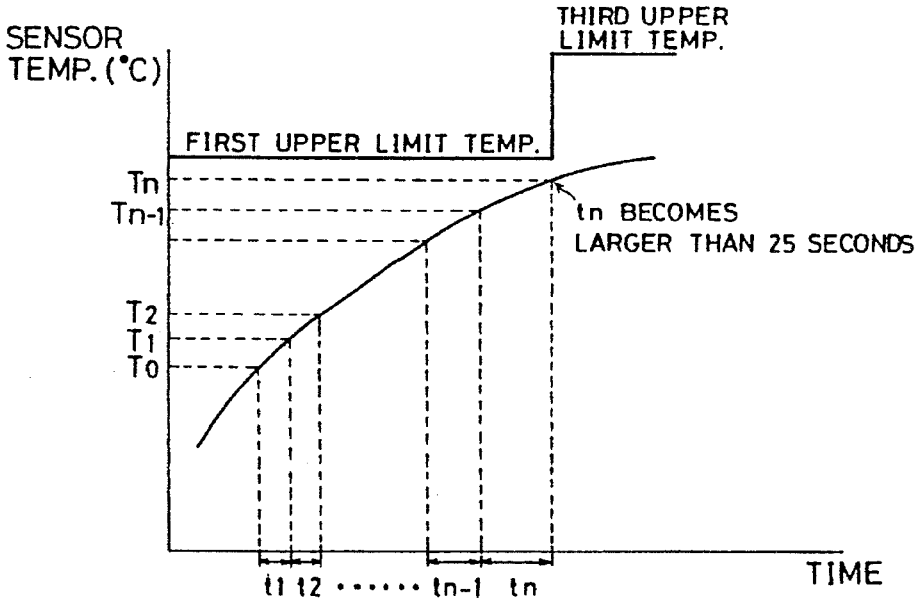
FIG. 8 is a graph showing a major portion of a temperature-time characteristic in cooking the deep-fried food.

Then, if the sensor temperature reaches a specific temperature ($T_n$: 190° C., for example: FIG. 8) in a step S63, the microcomputer 46 determines whether or not the temperature raising time ($t_n$) (any one of tl–tn shown in FIG. 8) per 10° C. from the initial temperature ($T_o$: 80° C., for example) to the specific temperature ($T_n$: 190° C., for example) was more than a predetermined time (25 seconds, for example). If any one of the temperature raising time ($t_n$) is more than the predetermined time, the microcomputer 46 determines that relatively much cooking oil is heated in the pan 38 at that time. In this case, in a step S67, the microcomputer 46 changes the above described first upper limit temperature (the step S5) to a third upper limit temperature, about 260° C., for example, that is suitable for the "deep-fried food" such as fry, tempura, or the like and the cooking oil is not flashed or ignited. Then, if the microcomputer 46 detects that the sensor temperature reaches the third upper limit temperature in a step S69, the process returns to the previous step S43 (FIG. 3B). Accordingly, the cooking oil in the pan 38 is never flashed or ignited. On the other hand, if a condition of the step S65 is not satisfied, the process returns to the step S43 when the microcomputer 46 detects that the sensor temperature reaches the first upper limit temperature (200° C., for example) in a step S71. Accordingly, even if tempura is cooked with a little oil by mistake, for example, an igniting or flashing accident can be prevented.

Figure 3E:
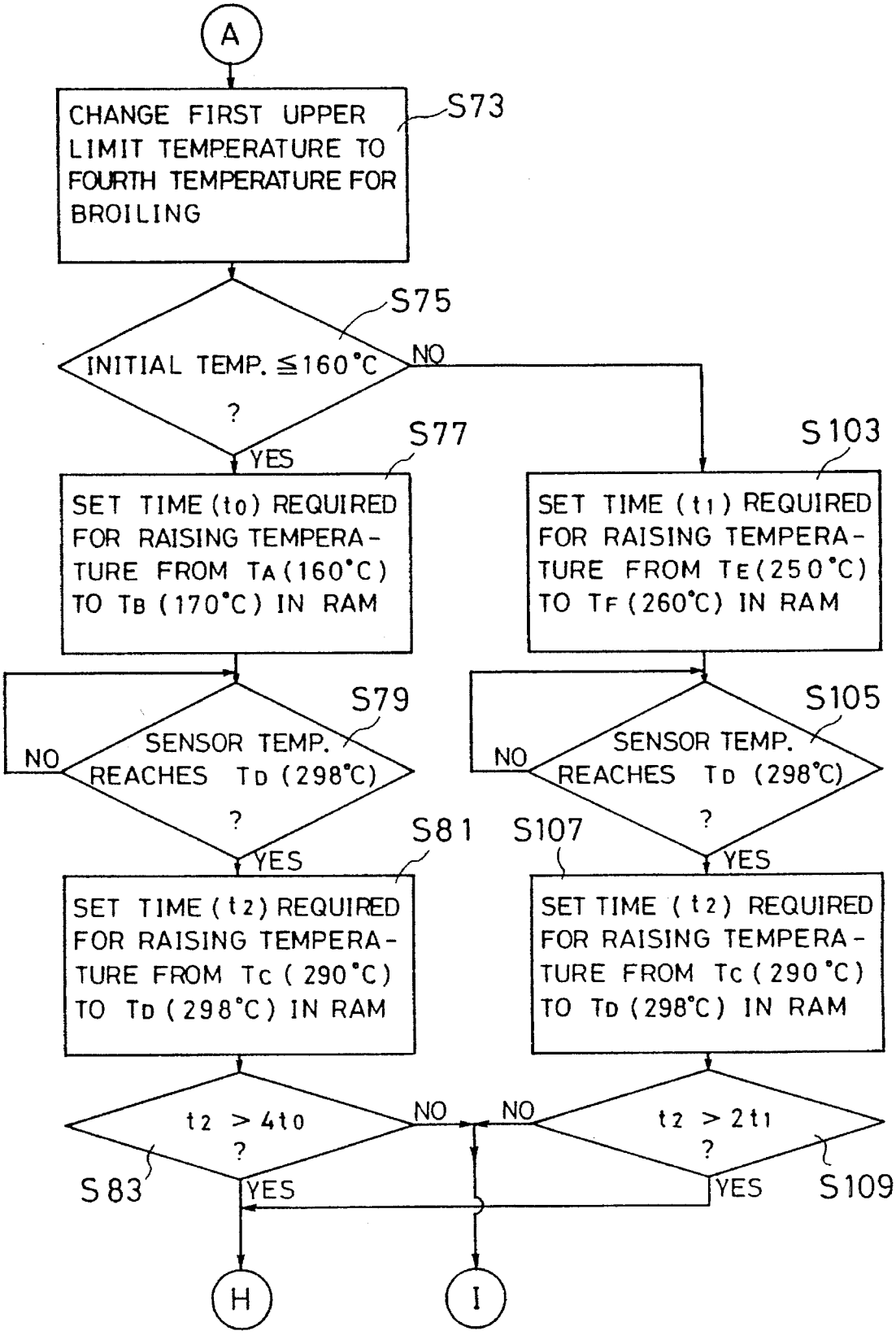
Figure 9:
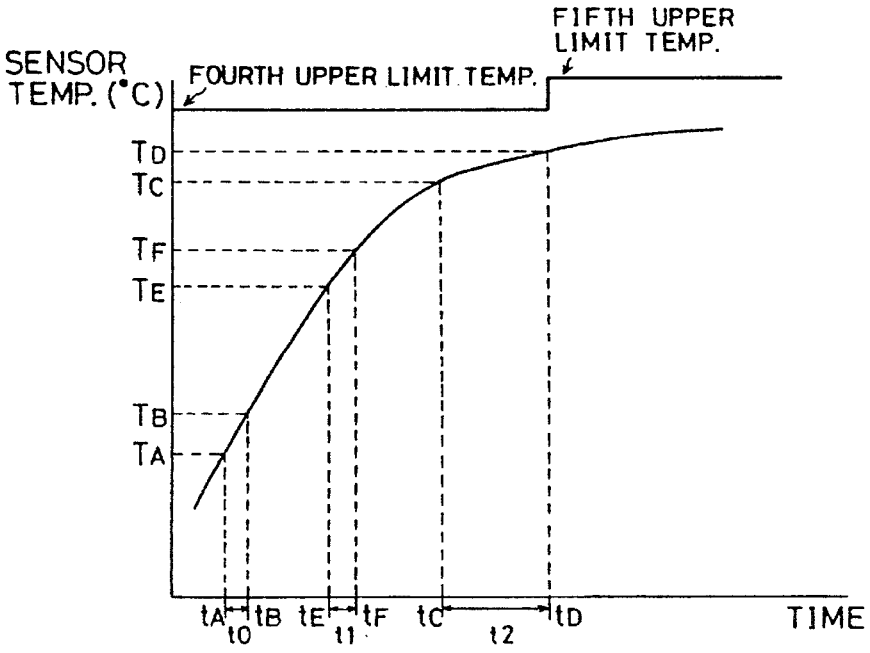
FIG. 9 is a graph showing a major portion of a temperature-time characteristic in cooking the broiled food.

If the broiling key 30 (see FIG. 2) is operated in the step S9 shown in FIG. 3A, in a step S73 shown in FIG. 3E, the microcomputer 46 changes the first upper limit temperature to a fourth upper limit temperature (307° C., for example) that is suitable for the "broiled food". In addition, in broiling the food, a grill is put on the trivet 36 and a fish or the like put on the grill is broiled by the ring gas burner 14. Accordingly, in this case, the temperature sensor 34 is partly brought into contact with an under surface of the grill. However, in this case, the temperature sensor 34 can also detect a temperature of the food effectively. Then, in a step S75, the microcomputer 46 detects the sensor temperature at a start of the broiling in response to an operation of the ignition button 18. In a case where the sensor temperature is higher than the temperature $T_A$ as shown in FIG. 9, the time (t0) cannot be counted. Accordingly, in this case, the microcomputer 46 determines whether or not the time (t2) is longer than twice the time (t1) on the basis of the time (t1) required for raising the temperature of the food by a predetermined temperature range ($T_E$–$T_F$), that is, t2>2t1.

More specifically, in the step S75, it is determined whether or not the initial temperature is less than the temperature $T_A$ (=160° C.) and, if less than 160° C., in a step S77, the microcomputer 46 detects the time (t0) required for raising the temperature of the food from the predetermined temperature ($T_A$: 160° C., for example) to another predetermined temperature ($T_B$: 170° C., for example) shown in FIG. 9, and stores the time (t0) in the RAM 52. Then, if it is detected that the sensor temperature reaches a temperature ($T_D$: 298° C., for example: FIG. 9) in a step S79, in a step S81, the microcomputer 46 detects a time (t2) required for raising the temperature of the food from a predetermined temperature ($T_C$: 290° C., for example) to another predetermined temperature ($T_D$: 298° C., for example), and stores the time (t2) in the RAM 52. Then, in a step S83, the microcomputer 46 determines whether or not the time (t2) is longer than four times the time (t0), that is, t2>4t0. If a such a condition is satisfied, in a step S85 shown in FIG. 3F, the microcomputer 46 determines that the food is "broiled food".

Then, in a step S87, the microcomputer 46 changes the fourth upper limit temperature to a fifth upper limit temperature of 330° C., for example, that is further higher than the fourth upper limit temperature on the basis of the above described determination result. If it is detected that the sensor temperature approaches the fifth upper limit temperature, that is, the sensor temperature reaches a temperature that is lower than the fifth upper limit temperature by 10° C., for example, in a step S89, in a step S91, the microcomputer 46 drives or rings the buzzer 58. Therefore, if the user manually turns the fire of the ring gas burner 14 down by operating the controller 22 in response to a notification by the buzzer 58, it is possible to prevent the temperature of the food from being raised too much in advance. Accordingly, the ring gas burner 14 is not extinguished before the cooking of the "broiled food" is finished.

Figure 10:
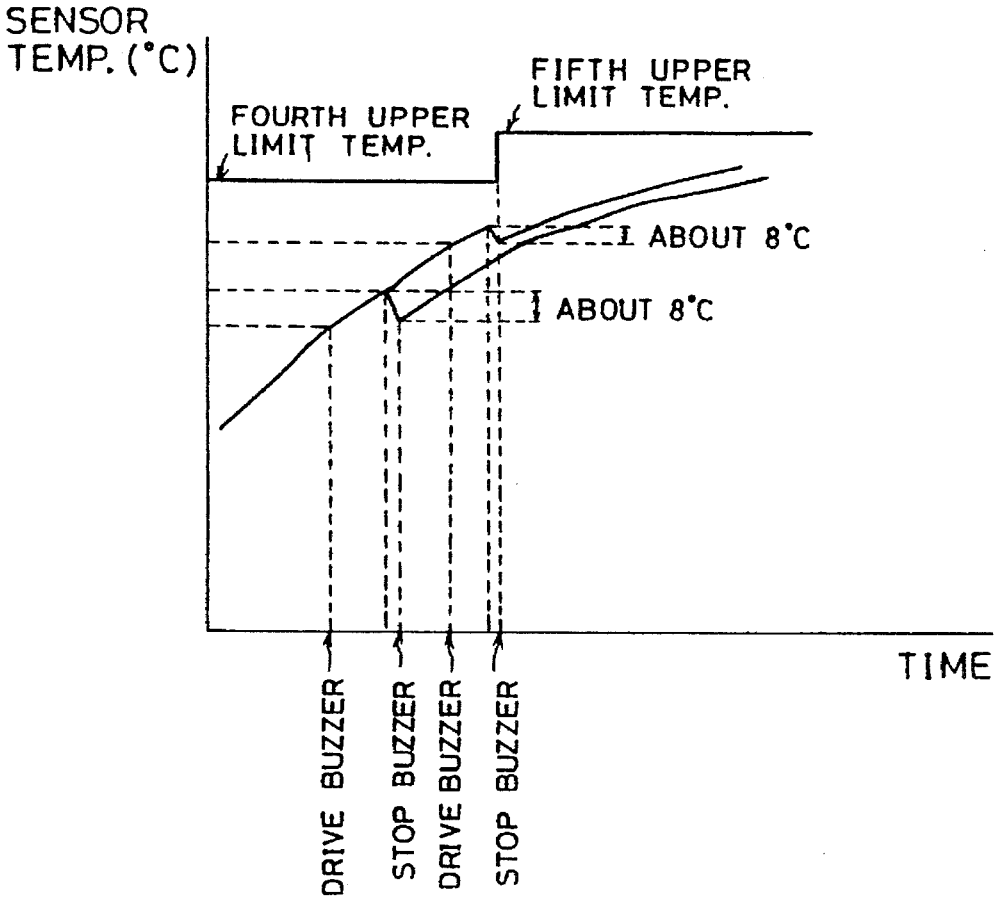
FIG. 10 is a graph showing a major portion of a temperature-time characteristic in cooking the broiled food.

Thereafter, as shown in FIG. 10, for example, if the sensor temperature drops by a predetermined temperature (about 8° C. in the embodiment) from the buzzer driving temperature by turning the fire of the ring gas burner 14 down in response to the notification of the buzzer 58, in a step S93, the microcomputer 46 stops the buzzer 58 ringing in a step S95. On the other hand, if the sensor temperature does not drop by the predetermined temperature from the buzzer driving temperature in the step S93, the process proceeds to a step S97. Then, if the sensor temperature reaches the fifth upper limit temperature, in a step S99 shown in FIG. 3G, the microcomputer 46 closes the solenoid valve 56, and stops the buzzer 58 ringing if the buzzer 58 is ringing yet and, in a step S101, the microcomputer 46 stops burning so as to terminate the cooking.

On the other hand, if the initial temperature exceeds the temperature ($T_A$=160° C.) in the step S75, in a step S103, the microcomputer 46 stores a time (t1) required for raising the temperature of the food from a predetermined temperature ($T_E$: 250° C., for example) to another predetermined temperature ($T_F$: 260° C., for example) in the RAM 52. Then, if the sensor temperature reaches the predetermined temperature ($T_D$: 298° C., for example) in a step S105, in a step S107, the microcomputer 46 stores a time (t2) required for raising the temperature of the food from the predetermined temperature ($T_C$: 290° C., for example) to the predetermined temperature (TD: 298° C., for example) in the RAM 52. Then, in a step S109, the microcomputer 46 determines whether or not the time (t2) is longer than twice the time (t1), that is, t2>2t2. When such a condition is satisfied, the process proceeds to the step S85.

Figure 3F:
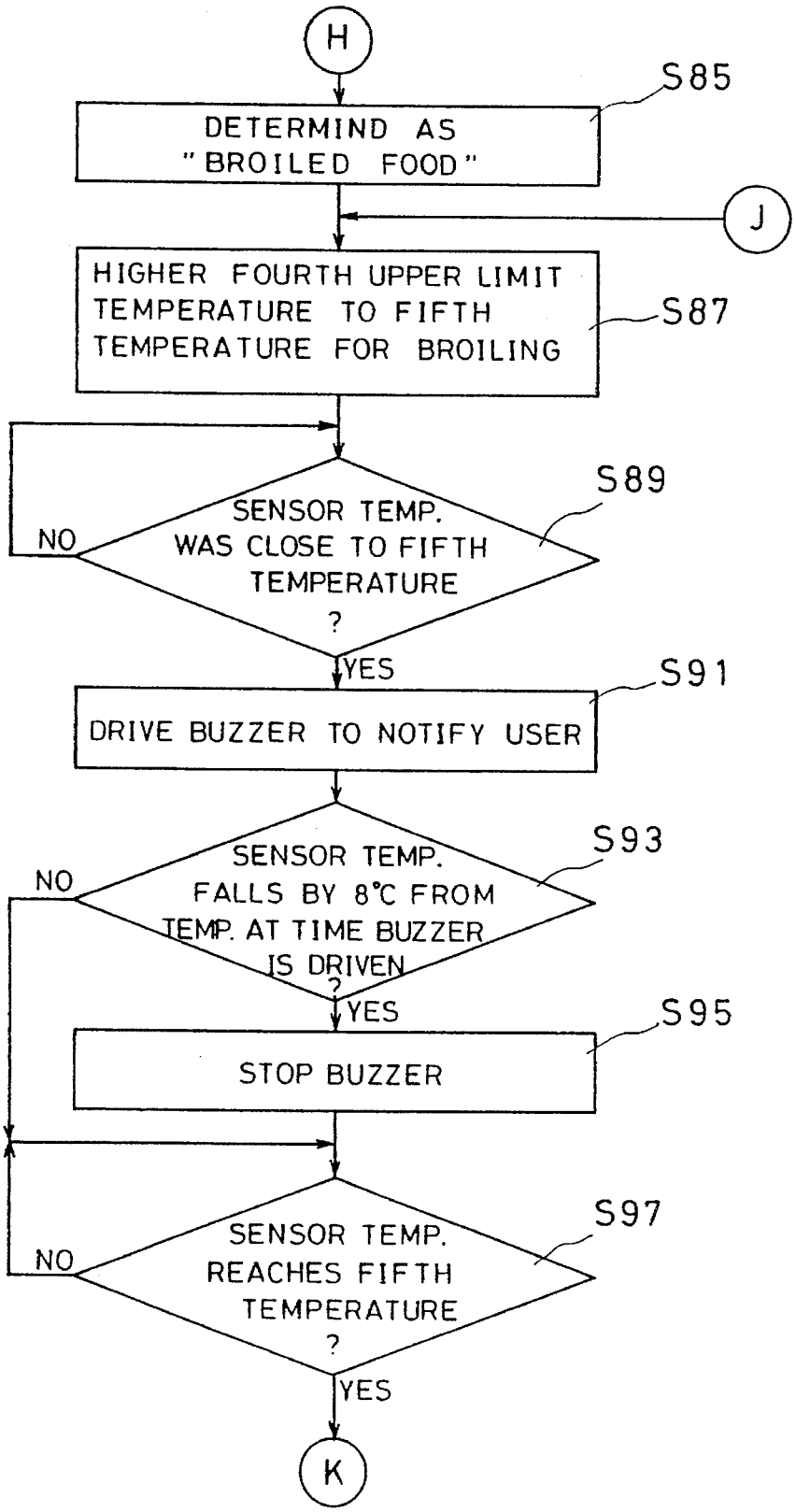
Figure 3G:
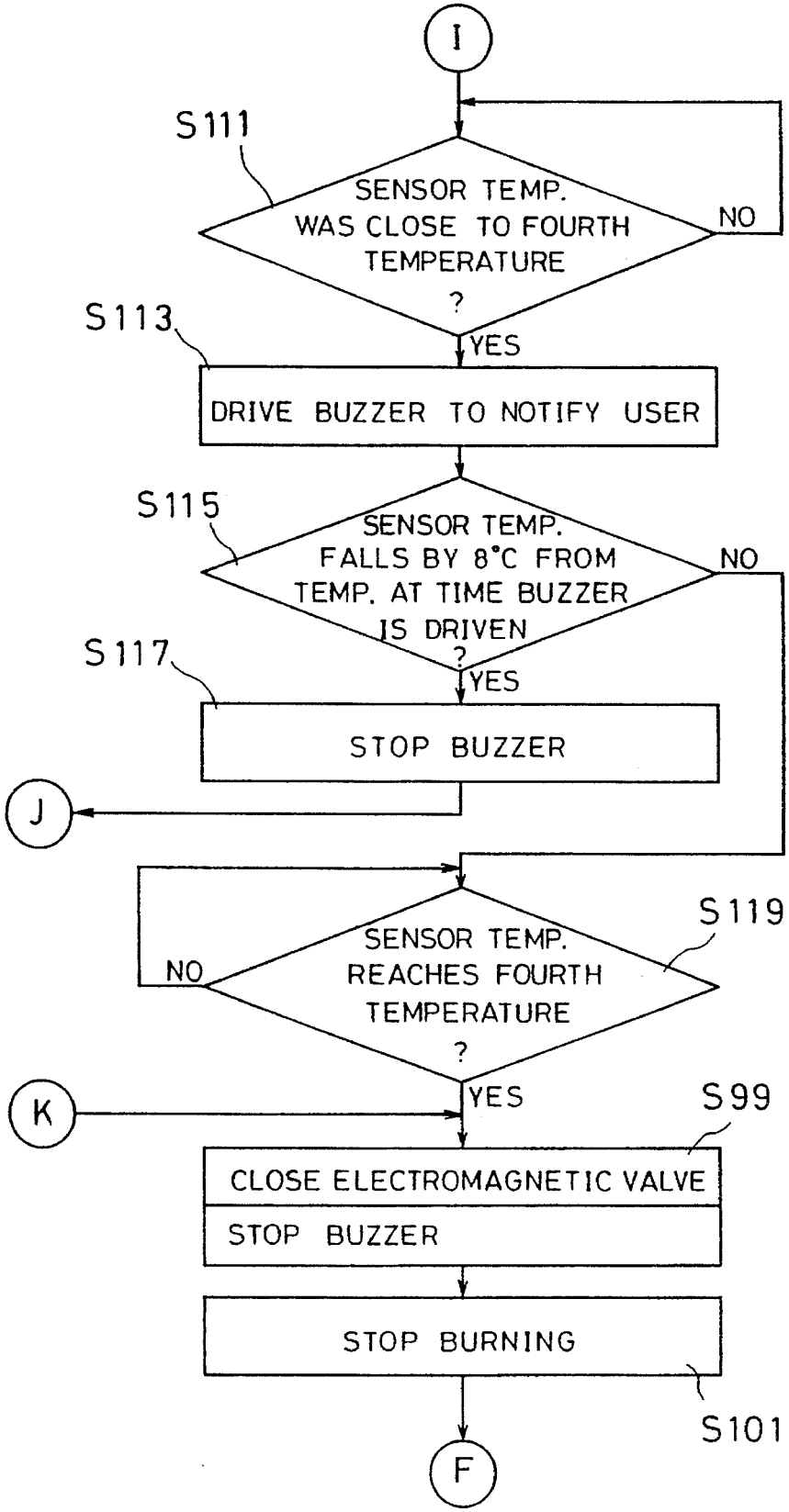

In a case where the condition of the step S109 or the step S83 is not satisfied, "broiled food" is not determined and, in a step S111 shown in FIG. 3G, the microcomputer 46 determines whether or not the sensor temperature approaches the fourth upper limit temperature, that is, the sensor temperature reaches a temperature lower than the fourth upper limit temperature by 10° C., for example. If "YES" is determined in the step S111, in a step S113, the microcomputer 46 drives the buzzer 58 so as to notify to the user that the temperature of the food is raised too much. That is, in a case where "broiled food" is not determined in spite of the user selects "broiled food" by depressing the broiling key 30 due to the kind or material of the grill, the slope of the grill or the like, the buzzer 58 notifies that the sensor temperature approaches the fourth upper limit temperature. As a result, the user is urged to turn the fire of the ring gas burner 14 down by operating the controller 22, and therefore, it is possible to prevent a problem that the ring gas burner 14 is extinguished during the cooking from occurring.

Then, if the sensor temperature drops by about 8° C. from the buzzer driving temperature in the step S115, in a step S117, the buzzer 58 is stopped, and the process goes to the step S87 (FIG. 3F). On the other hand, in a case where the sensor temperature does not drop by about 8° C. from the buzzer driving temperature in the step S115, in a step S119, the microcomputer 46 determines whether or not the sensor temperature reaches the fourth upper limit temperature. If the sensor temperature reaches the fourth upper limit temperature, the process proceeds to the step S99 (FIG. 3G). Accordingly, even if tempura, for example, is erroneously cooked in a state where the broiling key 30 is operated, it is possible to prevent a flashing of the cooking oil.

In addition, in the above, a description was made on the embodiment wherein a heat cooking apparatus to which the present invention is applied is a cooking gas table; however, such a heat cooking apparatus may be an electric heater, and an electromagnetic cooking apparatus using the induction heating, for example. In such a case, the temperature of the food is detected while the temperature sensor is brought into contact with the bottom of the pan or the grill as similar to the case of the cooking gas table in an electric heater wherein a heater such as a spiral heater or the like is exposed; however, in a case of an electric heater using a halogen heater or the electromagnetic cooking apparatus, a temperature of a heat-resistant glass board on which the pan is put is detected as the temperature of the food.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A heat cooking apparatus, comprising:

a controllable heat source for heating food;

a temperature sensor for detecting a food correlative temperature correlated with a temperature of said food;

time counting means for counting a time required for raising said food correlative temperature by a predetermined temperature;

determining means for determining a category of art of cooking of said food on the basis of the time counted by said time counting means, said determining means including first boiled food determining means which determines that the art of cooking of the food is "boiled food" when the temperature raising time is more than a predetermined value;

stop temperature setting means for setting stop temperatures that are different from each other according to said category of said art of cooking said food, said stop temperature setting means including boiled food termination temperature setting means for setting a boiled food termination temperature; and stopping means for stopping an operation of said controllable heat source when said food correlative temperature reaches any one of said stop temperatures.

2. A heat cooking apparatus according to claim 1, wherein said boiled food termination temperature setting means includes first determining means for determining whether or not said food correlative temperature exceeds a predetermined temperature, and said boiled food termination temperature setting means sets said boiled food termination temperature on the basis of a temperature at a timing when a raising gradient of said food correlative temperature becomes minimum after said food correlative temperature exceeds said predetermined temperature.

3. A heat cooking apparatus according to claim 2, wherein said stopping means stops the operation of said controllable heat source when said food correlative temperature reaches said boiled food termination temperature.

4. A heat cooking apparatus according to claim 2, further comprising second determining means for determining whether or not a temperature drop occurs within a predetermined time after said food correlative temperature reaches said boiled food termination temperature, and said stopping means does not stop the operation of said controllable heat source when it is determined that said temperature drop occurs within said predetermined time.

5. A heat cooking apparatus, comprising:

a controllable heat source for heating food;

a temperature sensor for detecting a food correlative temperature correlated with a temperature of said food;

time counting means for counting a time required for raising said food correlative temperature by a predetermined temperature;

determining means for determining a category of art of cooking of said food on the basis of the time counted by said time counting means, said determining means including fried food determining means for determining that the art of cooking of the food is "fried food" when the temperature raising time is less than said predetermined value and said food correlative temperature drops more than a predetermined value;

stop temperature setting means for setting stop temperatures that are different from each other according to said category of said art of cooking said food, said stop temperature setting means including fried food upper limit temperature setting means for setting a fried food upper limit temperature; and stopping means for stopping an operation of said controllable heat source when said food correlative temperature reaches any one of said stop temperatures.

6. A heat cooking apparatus according to claim 5, wherein said determining means includes second boiled food determining means for determining that the art of cooking of the food is "boiled food" when said food correlative temperature becomes less than a predetermined temperature after said fried food upper limit temperature is set by said fried food upper limit temperature setting means, and said stop temperature setting means includes boiled food termination setting means for setting a boiled food termination temperature.

7. A heat cooking apparatus according to claim 6, wherein said stopping means stops the operation of said controllable heat source when said food correlative temperature reaches said fried food upper limit temperature.

8. A heat cooking apparatus, comprising:

a controllable heat source for heating food;

a temperature sensor for detecting a food correlative temperature correlated with a temperature of said food;

time counting means for counting a time required for raising said food correlative temperature by a predetermined temperature;

determining means for determining a category of art of cooking of said food on the basis of the time counted by said time counting means, said determining means including deep-fried food determining means for determining that the art of cooking of the food is "deep-fried food" when the temperature raising time is less than said predetermined value and said food correlative temperature does not drop more than a predetermined value;

stop temperature setting means for setting stop temperatures that are different from each other according to said category of said art of cooking said food, said stop temperature setting means including deep-fried food upper limit temperature setting means; and stopping means for stopping an operation of said controllable heat source when said food correlative temperature reaches any one of said stop temperatures.

9. A heat cooking apparatus according to claim 8, further comprising notifying means for notifying to a user that said food correlative temperature reaches a suitable temperature after said deep-fried food determining means determines that the art of cooking of the food is "deep-fried food".

10. A heat cooking apparatus according to claim 9, wherein said deep-fried food upper limit temperature setting means sets said deep-fried food upper limit temperature when any one of temperature raising times within predetermined temperature ranges until said food correlative temperature reaches a predetermined temperature becomes more than a predetermined value.

11. A heat cooking apparatus according to claim 10, further comprising first upper limit temperature setting means for setting a first upper limit temperature just after a start of cooking, and said stopping means stops the operation of said controllable heat source when said food correlative temperature reaches said first upper limit temperature if all the temperature raising times within predetermined temperature ranges until said food correlative temperature reaches the predetermined temperature is less than a predetermined value.

12. A heat cooking apparatus, comprising:

a broiling key for selecting broiled food cooking;

a controllable heat source for heating food;

a temperature sensor for detecting a food correlative temperature correlated with a temperature of said food;

time counting means for counting a time required for raising said food correlative temperature by a predetermined temperature;

determining means for determining a category of art of cooking of said food on the basis of the time counted by said time counting means, said determining means determining that the art of cooking of the food is "broiled food" by comparing the temperature raising time within a first predetermined temperature range with the temperature raising time within a second predetermined temperature range that is higher than said first predetermined temperature range;

stop temperature setting means for setting stop temperatures that are different from each other according to said category of said art of cooking said food, said stop temperature setting means setting a first broiled food upper limit temperature in response to an operation of said broiling key, said stop temperature setting means further setting a second broiled food upper limit temperature that is higher than said first broiled food upper limit temperature in response to determination of "broiled food" by said determining means; and stopping means for stopping an operation of said controllable heat source when said food correlative temperature reaches any one of said stop temperatures.

13. A heat cooking apparatus according to claim 12, further comprising first notifying means for notifying to a user that said food correlative temperature approaches said second broiled food upper limit temperature.

14. A heat cooking apparatus according to claim 12, wherein a third temperature range that is higher than said first temperature range and lower than said second temperature range is set when said food correlative temperature is higher than said first temperature range, and said determining means determines that the art of cooking of the food is "broiled food" by comparing the temperature raising time within said second temperature range with the temperature raising time within said third temperature range.

15. A heat cooking apparatus according to claim 14, further comprising second notifying means for notifying to a user that said food correlative temperature approaches said second broiled food upper limit temperature.

16. A heat cooking apparatus according to claim 12, further comprising third notifying means for notifying to a user that said food correlative temperature approaches said first broiled food upper limit temperature; and notification stopping means for stopping said third notifying means when said food correlative temperature drops to a temperature that is lower than a temperature at a timing when said third notifying means is operated by said third notifying means, and said stop temperature setting means changes said first broiled food upper limit temperature to said second broiled food upper limit temperature.

* * * * *